US006993847B2

(12) United States Patent
Melton et al.

(10) Patent No.: US 6,993,847 B2
(45) Date of Patent: Feb. 7, 2006

(54) HANGER HOOK FOR CLIPPERS

(75) Inventors: Scott A. Melton, Erie, IL (US); Raymond A. Nielson, Sterling, IL (US); Edward D. Brill, Sterling, IL (US)

(73) Assignee: Wahl Clipper Corporation, Sterling, IL (US)

( * ) Notice: Subject to any disclaimer, the term of this patent is extended or adjusted under 35 U.S.C. 154(b) by 108 days.

(21) Appl. No.: 10/624,222

(22) Filed: Jul. 22, 2003

(65) Prior Publication Data

US 2005/0015999 A1 Jan. 27, 2005

(51) Int. Cl.
*B26B 19/38* (2006.01)

(52) U.S. Cl. ..... 30/216; 30/298.4; 248/37.6; 248/215

(58) Field of Classification Search ..... 30/210, 30/216, 298.4, 537, 541; 248/690, 692, 693, 248/215, 37.6; 211/13.1, 70.7, 106.1
See application file for complete search history.

(56) References Cited

U.S. PATENT DOCUMENTS

| | | | | | |
|---|---|---|---|---|---|
| 1,360,778 | A | * | 11/1920 | Armond | 30/216 |
| 1,788,009 | A | * | 1/1931 | Bestler | 248/224.7 |
| 1,811,903 | A | * | 6/1931 | Bree | 30/216 |
| 2,639,820 | A | * | 5/1953 | Lee | 211/163 |
| 2,841,192 | A | | 7/1958 | Martin | |
| 3,580,401 | A | | 5/1971 | Stahl | |
| 3,850,401 | A | | 11/1974 | Snediker | |
| 3,981,471 | A | * | 9/1976 | Currier | 248/317 |
| 4,406,064 | A | | 9/1983 | Goss | |
| 4,787,145 | A | | 11/1988 | Klicker et al. | |
| 4,867,184 | A | * | 9/1989 | Davis | 132/214 |
| 5,014,948 | A | * | 5/1991 | Asaro et al. | 248/215 |
| 5,222,132 | A | * | 6/1993 | Rioux, Jr. | 379/455 |
| 5,924,579 | A | * | 7/1999 | DuPont et al. | 211/70.6 |
| 6,098,558 | A | | 8/2000 | Baird | |
| 2004/0111896 | A1 | * | 6/2004 | David | 30/298.4 |

FOREIGN PATENT DOCUMENTS

| | | | |
|---|---|---|---|
| CH | 605 053 | * | 9/1978 |

* cited by examiner

*Primary Examiner*—Hwei-Siu Payer
(74) *Attorney, Agent, or Firm*—Greer, Burns & Crain, Ltd.

(57) ABSTRACT

A portable clipper holding apparatus includes a generally "S"-shaped structure having a first arch and a second arch, the first and second arches positioned in an inverted relationship to one another. The first arch is configured for engaging a substrate and the said second arch configured for receiving at least one clipper and/or accessories.

20 Claims, 2 Drawing Sheets

HANGER HOOK FOR CLIPPERS

BACKGROUND OF THE INVENTION

This invention relates to devices for supporting appliances or tools on a substrate, and more specifically to a hanger hook for a clipper.

Available storage spaces for resting a hair clipper, while not in use, are often limited in places where hair is likely to be cut. In the hair care industry, stylists or beauticians often work in small areas with limited countertop space or flat resting places for hair cutting tools. This situation leaves little empty storage space for a beautician to store a hair cutting tool, even temporarily. Likewise, household bathrooms or kitchens often have little space that is flat and level to store a hair clipper. Bottles, soaps, and cooking utensils often clutter countertops which already have limited space, because a sink occupies a significant amount of the countertop in many cases. Pedestal sinks, which eliminate bathroom countertops, invariably have even less usable storage space for a hair clipper. Other potential resting places in a bathroom, such as toilets or the sides of bathtubs, again, have little surface space to reasonably store a hair clipper.

Moreover, if empty resting space is available in these small beauty salon, kitchen, or bathroom work areas, the resting surfaces are not secure places to store a hair clipper, which has sharp blades, is heavy, and is powered by electricity. A hair clipper can very likely slide off of a flat surface like a countertop, especially if it rests near an edge, as occurs when the countertop is full of other objects. A falling hair clipper can become damaged or destroyed.

Clean resting surfaces may also be hard places to find for resting a clipper. Beauty salons are full of cut hair on counters and floors. Indeed, clippers contribute to the untidiness of cut hair. However, resting a clipper on a flat surface only fosters the build-up off hair clippings, which can end up on a user's hands, etc.

Despite the problems with limited the resting surfaces for a clipper, as mentioned above, a mobile user may not have any potential resting surfaces nearby at all. If a mobile user then becomes suddenly distracted, by the needs of a child for instance, or is called upon to perform another more urgent task, and there are no proximate resting places, the user must either inconveniently put the clipper down on the floor or unpleasantly continue to hold the clipper. In these situations, finding a resting place for the clipper becomes an annoyance.

Thus, there is a need for a convenient and quickly securable resting place for a clipper. There is also a need for a hanger hook for a clipper configured so that the clipper can be mounted on a drawer, belt, or waistline portion of a user's clothing.

BRIEF SUMMARY OF THE INVENTION

The above-listed needs are met or exceeded by the present hanger hook for clippers or portable clipper holding apparatus that mounts on drawers or belts. The hanger hook has at least one hook configured for receiving and holding clippers. A first arch provides support with first and second walls to securely hold the hanger hook having at least one mounted clipper in a position on a drawer. Also, the second wall provides comfort and stability to securely hold the hook with mounted clipper on a belt. A contoured shape of the second wall conforms to a user's waistline for comfort and stability. Lateral extensions protruding from the second wall and extending beyond the length of the first arch on both sides provide additional support as a belt pushes the extensions against a user's waistline. The hanger hook, having three generally parallel and equally spaced hooks, can hold at least one clipper and other accessories such as scissors, towels, combs, brushes, etc. for quick and easy access. Gussets are preferably provided to strengthen the hook and enable it to hold the weight of hair clippers, which can be substantial.

More specifically, the present invention provides a portable clipper holding apparatus including a generally S-shaped structure having a first arch and a second arch. The first and second arches are positioned in an inverted relationship to each other. The first arch is configured for engaging a substrate, and the second arch is configured for receiving at least one hair clipping device.

When space is limited to store clippers, the hanger hook is securable to drawers and belts for additional storage. Limited storage space is a situation encountered in small areas, where clippers are especially used, such as beauty salons, kitchens, and bathrooms. Moreover, the hanger hook provides a convenient resting place for clippers. Using clippers is often a non-continuous process, whereby the user intermittently uses clippers along with other hair cutting tools. Also, a parent cutting the hair of a child may have to quickly rest the clipper to attend to a more urgent matter. The hanger hook provides quick and easy replacement and retrieval of clippers. Clippers are easily hung on hooks outside of a drawer or outside of clothing. Users no longer have to sort through cluttered drawers or clothes pockets to find clippers that have been just temporarily set aside. Further, the present hanger hook is a dedicated storage space for clippers. Further, a user easily locates the clipper by memory of the position of the present hanger hook, instead of having to remember the last place the clipper had been rested.

Further, by engaging the hanger hook upon a belt, the hanger hook allows the user to be more mobile and not restricted to a particular area, that is, other than by the length of cord. Clippers can be easily accessed by a user at the user's waistline, preventing the user from having to reach for the clipper on a countertop or in a drawer, which lies a few feet away. The present hanger hook can be mounted in a number of different ways at the user's discretion.

Despite providing additional and convenient storage space, the present hanger hook provides a secure and clean resting place for the clipper. Because clippers are often used intermittently, the user frequently picks up the clipper and puts it back down. When rested on a horizontal surface, which can have hair clippings and can be slippery, clippers can easily be knocked off the surface by the user.

Lastly, the present hanger hook provides a more tidy area for clipper use. Clippers are neatly hung on drawers. Hair clippings can fall to the floor and be quickly swept up with other hair clippings in a beauty salon, instead of collecting on countertops and tables, and inside drawers and pockets.

DETAILED DESCRIPTION OF THE INVENTION

Figure 1:
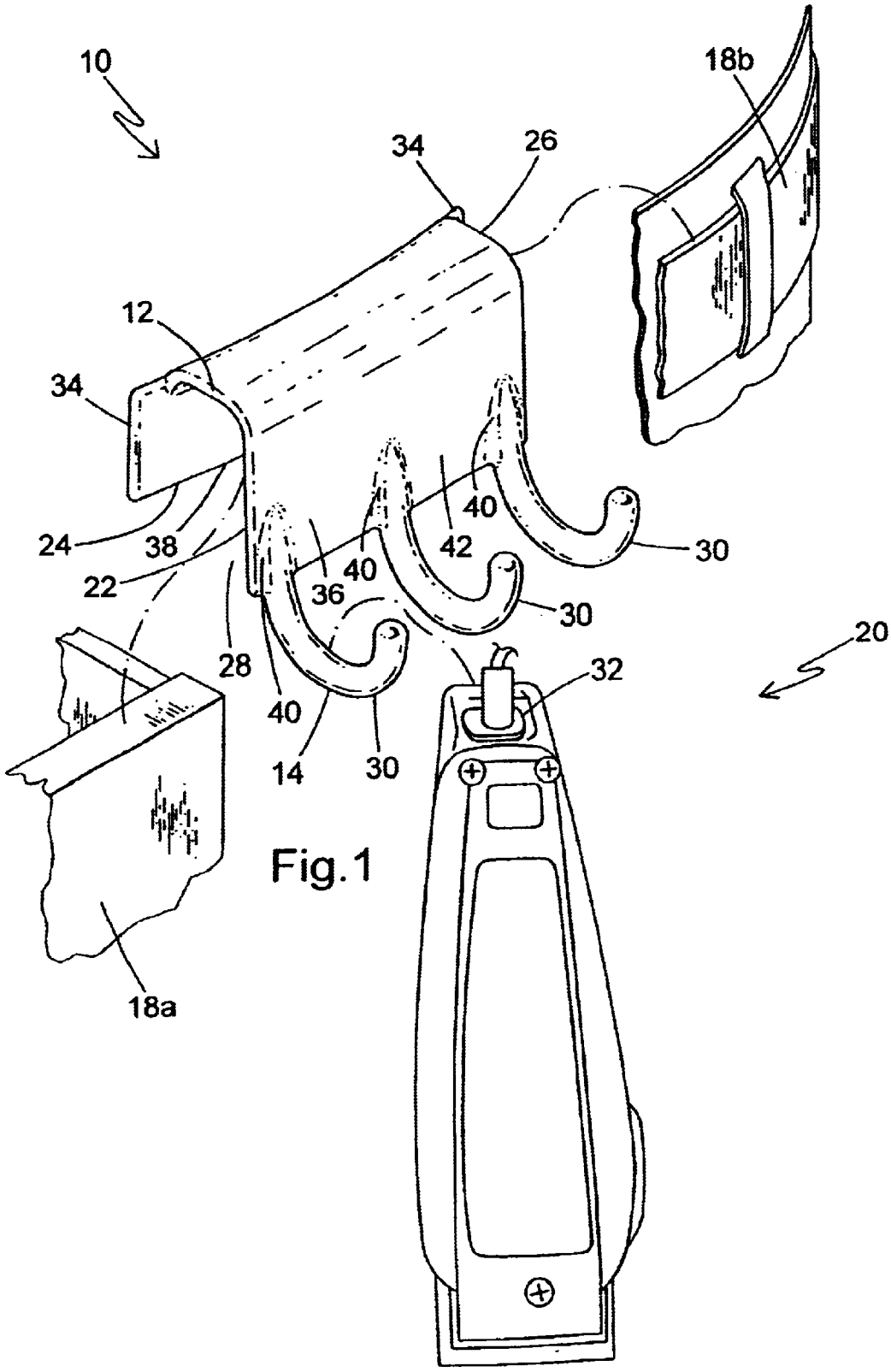
FIG. 1 is a perspective view of the present hanger hook, shown mountable on either a drawer or a belt and accepting a clipper, all shown exploded.
Figure 2:
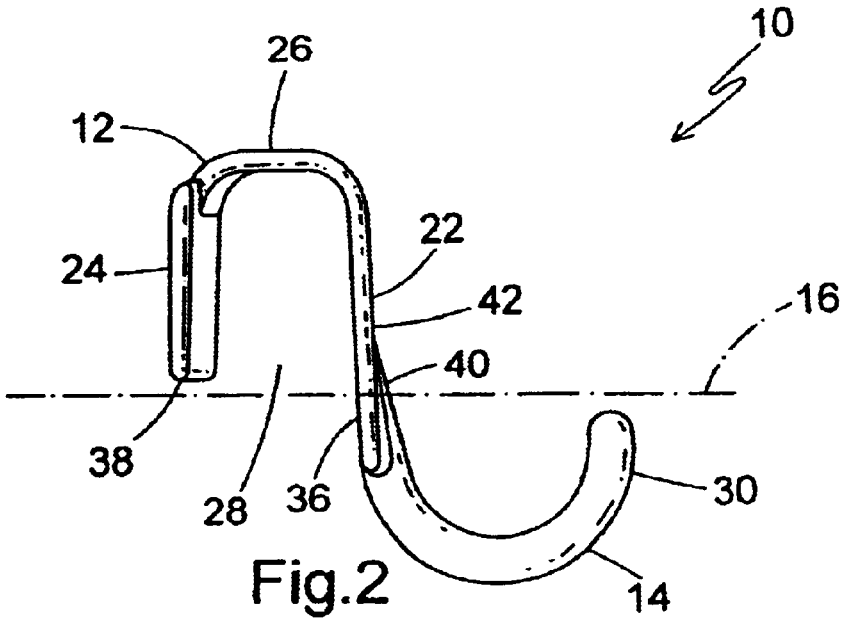
FIG. 2 is a side view of the present hanger hook.

Referring to FIGS. 1 and 2, a portable clipper holding apparatus or hanger hook is generally designated 10 and is designed for holding at least one clipper on drawers and/or belts or waistbands. The apparatus 10 has a generally "S"-shaped structure having a first arch 12 and a second arch 14 positioned in an inverted relationship to one another relative to a horizontal plane 16. The first arch 12 is configured for engaging a substrate 18, preferably a drawer 18*a* or a belt or waistband 18*b*. The second arch 14 is configured for receiving at least one clipper 20.

Figure 3:
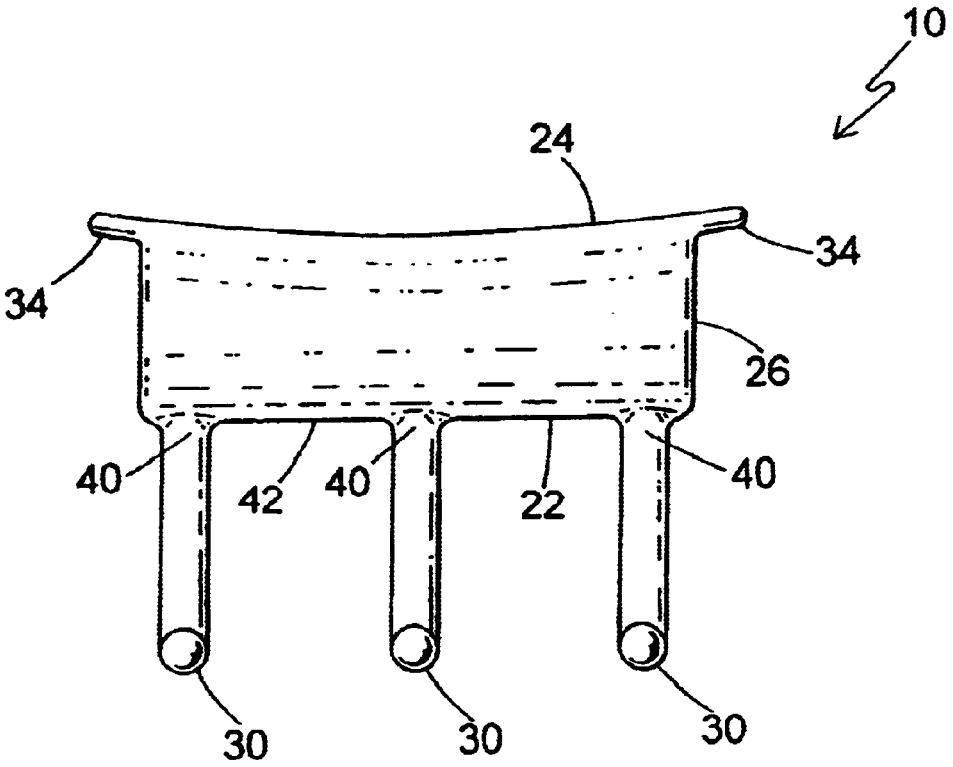
FIG. 3 is a top view the present hanger hook.

As shown in FIGS. 1–3, a first wall 22 connects the first and second arches 12,14. Also, a second wall 24, which is attached to a top 26 of the first arch 12, forms a bottom opening 28 for engaging the substrate. In the preferred embodiment at least one and preferably three hooks 30 form the second arch 14. As shown, the hooks 30 are preferably "U"-shaped, however other configurations are contemplated depending on the application. Also, it is envisioned that all three hooks 30 need not have the same shape. It is also preferred that the hooks 30 are equally spaced apart along the length of the first wall 22 and in a generally parallel relationship to one another.

The clipper 20 is provided with a hanger loop 32 which is preferably closed and is configured to support the weight of the clipper. An open loop design is also contemplated.

The second wall 24 is configured to provide comfortable contact with the user and to provide additional stability for the apparatus 10. As best shown in FIGS. 1 and 3, the second wall 24 has a contoured profile which generally conforms to the waistline of a user. When the apparatus 10 engages the belt 18*b*, the belt forces the second wall 24 into the user. Since the contoured profile of the second wall 24 contacts the user more completely, it stabilizes the forces from the mounted clipper 20 and holds the apparatus 10 in position. Further, the second wall 24 has two lateral extension portions 34 that protrude from the sides of the second wall 24, as shown best in FIGS. 1 and 3. The lateral extension portions 34 also provide the apparatus 10 with additional stability by making greater contact between the surface of the user and the apparatus 10 as the belt 18*b* forces the lateral extensions to contact the user.

Further, the first wall 22 is configured for holding the apparatus 10 in relatively stabilized fashion and in desired position. A bottom portion 36 of the first wall 22 extends below a bottom edge 38 of the second wall 24. The bottom portion 36 helps the apparatus 10 more completely contact the belt 18*b* and the drawer 18*a*, depending on which substrate has been engaged. In the preferred embodiment, the bottom portion 36 extends below the bottom edge 38 by at least one half of the height of the second wall 24. Since the bottom portion 36 extends further down the front face of the drawer 18*a* and belt 18*b*, it has more surface area to press against the drawer and belt for additional stability.

Clippers can weigh a relatively large amount for their size, because, among other things, there is normally a relatively heavy internal motor powering such clippers. Therefore, supporting gussets 40, as best shown in FIG. 1 and 2, are provided on the hooks 30, adding holding strength.

In addition, the first wall 22 is configured for protecting the substrate 18*a*, 18*b* and the user. There is a sufficient space between the bottom portion 36 and the top 26 to define a strike plate 42. The strike plate 42 absorbs impact caused by the clipper 20 engaging the apparatus 10.

The present hanger hook 10 is preferably one piece integrally molded out of plastic or equivalent sturdy, yet relatively inexpensive material. In addition, the present hanger hook 10 preferably has radiused edges, which allow a user to slide it smoothly into a desired position and prevent the hook from catching on clothing, etc.

It is evident from the description that the present hanger hook provides a user with numerous benefits. When empty storage space is unavailable in the surrounding area, the present hanger hook gives the user additional storage space. Moreover, the present hanger hook allows the user to more securely rest the clipper in convenient location, such as on a drawer or on a belt worn by a user. Hanging a clipper in this fashion allows the user to quickly and easily rest and retrieve the clipper, instead of fumbling for a clipper that had been placed in a cluttered pocket or drawer, or on a cluttered countertop or table. Intermittent resting is typical during clipper use, and the present hanger hook benefits a stylist who frequently sets down a clipper to temporarily use another hair cutting tool. Among other users, the present hanger hook also benefits parents who, while cutting their child's hair, suddenly need to attend to more urgent matters. The present hanger hook gives the user a dedicated place to set down the clipper. The user can immediately find a resting place for the clipper and avoid the hazards of hastily setting the clipper on an insecure surface, where the clipper can fall. In this way, the hanger hook mitigates risk of damage to the clipper or surroundings. Further, the hanger hook provides a mobile clipper resting place for a user that may be relatively distant from a countertop or table. Also, a user can keep a tidy appearance for a work area through the use of the present hanger hook. Clippers can be neatly stored on the face of drawers instead of cluttering a countertop. Instead of gathering on countertops, hair clippings can fall to the floor, which commonly in beauty salons is cleaned more frequently than other surfaces.

While a particular embodiment of the present hanger hook for clippers has been shown and described, it will be appreciated by those skilled in the art that changes and modifications may be made thereto without departing from the invention in its broader aspects and as set forth in the following claims.

What is claimed is:

1. A portable clipper holding apparatus for holding at least one hair clipping device on at least one of a drawer and a belt, comprising:

a first arch having a top, a first wall, a second wall, and a bottom opening, configured for attachment to one of the drawer and the belt;

said first wall having a bottom portion extending below a bottom edge of said second wall by at least one half of the height of said second wall;

said first wall configured to provide space between said bottom portion and said top to define a strike plate;

said second wall having two lateral extension portions which extend beyond lateral sides of said first wall;

said second wall having a contoured shape; and three hooks extending from said bottom portion of said first wall, wherein said hooks are equally spaced along the length of the first wall and positioned in a generally parallel relationship to each other.

2. The apparatus of claim 1 wherein each said hook is provided with a supporting gusset.

3. A portable clipper holding apparatus comprising:

a generally "S"-shaped structure having a first arch and a second arch, said first and second arches positioned in an inverted relationship to one another;

said first arch configured for engaging a substrate;

said second arch configured for receiving at least one clipper;

a first wall connecting said first and second arches;

a second wall attached to a top of said first arch forms a bottom opening for engaging the substrate; and said second wall has a contoured shape for conforming to the waistline of a user.

4. The portable clipper holding apparatus of claim 3 in combination with at least one clipper, and wherein said at least one clipper has at least one of an open and a closed loop for engaging said second arch for supporting the weight of the clipper.

5. The portable clipper holding apparatus of claim 3 wherein said second wall has two lateral extension portions extending from its sides to the extent of surpassing the lateral dimensions of said first wall.

6. The portable clipper holding apparatus of claim 3 wherein said a first wall and a second wall are separated by a top forming said first arch and said bottom portion of said first wall extends below a bottom edge of said second wall.

7. The portable clipper holding apparatus of claim 6 wherein said bottom portion extends beyond the bottom edge of said second wall by at least one half of the height of said second wall.

8. The portable clipper holding apparatus of claim 6 wherein the first wall provides sufficient space between the bottom portion and the top to define a strike plate.

9. The portable clipper holding apparatus of claim 3 further including at least one hook forming said second arch.

10. The portable clipper holding apparatus of claim 9 wherein said at least one hook includes three hooks being equally spaced along the length of the first wall and positioned in a generally parallel relationship to each other.

11. The portable clipper holding apparatus of claim 9 wherein each said at least one hook is provided with a supporting gusset.

12. A portable clipper holding apparatus in combination with a hair clipping device comprising:

a hair clipping device having a housing with a closed or opened loop for attaching to the portable clipper holding apparatus;

a generally "S"-shaped structure having a first arch and a second arch, said first and second arches positioned in an inverted relationship to one another;

said first arch configured for engaging a substrate; and said second arch configured for receiving the hair clipping device, three hooks forming said second arch and being equally spaced along the length of a first wall and positioned in a generally parallel relationship to each other.

13. The combination holding apparatus and clipping device of claim 12 wherein said a first wall connects said first and second arches.

14. The combination holding apparatus and clipping device of claim 13 wherein a second wall attached to a top of said first arch forms a bottom opening for engaging the substrate.

15. The combination holding apparatus and clipping device of claim 14 wherein said second wall has a contoured shape for conforming to the waistline of a user.

16. The combination holding apparatus and clipping device of claim 14 wherein said second wall has two lateral extension portions extending from its sides to the extent of surpassing the lateral dimensions of said first wall.

17. The combination holding apparatus and clipping device of claim 12 further including a second wall, wherein said first wall and said second wall are separated by a top forming said first arch wherein a bottom portion of said first wall extends below a bottom edge of said second wall.

18. The combination holding apparatus and clipping device of claim 17 wherein said bottom portion extends beyond the bottom edge of said second wall by at least one half of the height of said second wall.

19. The combination holding apparatus and clipping device of claim 17 wherein the first wall provides sufficient space between the bottom portion and the top to define a strike plate.

20. The combination holding apparatus and clipping device of claim 12, wherein each said hook is provided with a supporting gusset.

* * * * *

UNITED STATES PATENT AND TRADEMARK OFFICE

CERTIFICATE OF CORRECTION

PATENT NO. : 6,993,847 B2
APPLICATION NO. : 10/624222
DATED : February 7, 2006
INVENTOR(S) : Melton et al.

It is certified that error appears in the above-identified patent and that said Letters Patent is hereby corrected as shown below:

In the Claims:

Col. 5, line 16, delete "a second" and insert --said second--

Col. 5, line 17, delete "said bottom" and insert --a bottom--

Col. 6, line 11, delete "a"

Signed and Sealed this
Twentieth Day of December, 2011

David J. Kappos

David J. Kappos
*Director of the United States Patent and Trademark Office*